United States Patent [19]

Barth et al.

[11] 4,296,697

[45] Oct. 27, 1981

[54] SEWING MACHINE WITH A WORK HOLDER FOR WRAPPING BUTTON SHANKS

[75] Inventors: Karl Barth; Ernst Albrecht, both of Hochspeyer; Horst Stahlschmitt, Kaiserslautern, all of Fed. Rep. of Germany

[73] Assignee: Pfaff Industriemaschinen GmbH, Fed. Rep. of Germany

[21] Appl. No.: 212,563

[22] Filed: Dec. 3, 1980

[30] Foreign Application Priority Data

Dec. 5, 1979 [DE] Fed. Rep. of Germany ..... 7934154

[51] Int. Cl.[3] ..... D05B 3/16; D05B 53/00

[52] U.S. Cl. ..... 112/109; 112/298

[58] Field of Search ..... 112/109, 108, 104, 111, 112/112, 298

[56] References Cited

U.S. PATENT DOCUMENTS

| | | | |
|---|---|---|---|
| 698,342 | 4/1902 | Wanless | 112/109 |
| 1,931,830 | 10/1933 | Rick | 112/108 |
| 2,630,087 | 3/1953 | Liero et al. | 112/108 |
| 3,163,135 | 12/1964 | Kell | 112/108 X |
| 3,357,387 | 12/1967 | Owens | 112/298 |
| 3,680,506 | 8/1972 | Albrecht et al. | 112/112 |

*Primary Examiner*—H. Hampton Hunter

*Attorney, Agent, or Firm*—McGlew and Tuttle

[57] ABSTRACT

A sewing machine for wrapping button shanks comprises a holder for a workpiece to which a button is attached by means of shank loops. To adjust the work holder to the length of the shank loops, two spaced apart holding elements are provided by which the work is separated from the button and which can be positioned at the desired distance from each other. To cut the sewing thread, a cutting blade is displaceable in one of the holding elements and the cutting edge of the blade is movable transversely to the needle path, between the inserted shank loops and a rotary hook.

8 Claims, 5 Drawing Figures

SEWING MACHINE WITH A WORK HOLDER FOR WRAPPING BUTTON SHANKS

FIELD AND BACKGROUND OF THE INVENTION

The present invention relates in general to sewing machines, and in particular, to a new and useful device for wrapping button shanks connecting a workpiece to a button with thread in a sewing machine comprising adjustably spaced holding elements between which the button shanks extend.

Sewing machines for wrapping button shanks are equipped with a work holder by which the distance between the button and the work is fixedly predetermined. Consequently, long button shanks are not satisfactorily stretched and they may be pierced during the sewing operation. In addition, slack shank loops cause an irregular wrapping unfavorably affecting the appearance of the finished button shank.

SUMMARY OF THE INVENTION

The present invention is directed to a work holder of a sewing machine for wrapping button shanks, which improves the wrapping of button loops of an attached button. Due to the provisions in accordance with the invention, the shank loops are properly stretched during the wind-around operation and are wrapped in a position proper for sewing.

Accordingly, an object of the present invention is to provide a device for wrapping button shanks connecting a workpiece to a button with thread in a sewing machine comprising, a first holding element against which the workpiece can bear, a second holding element against which the button can bear, spaced from the first holding element with the shank extending between the holding elements, and adjustment apparatus connected to the first and second holding elements for adjusting the spacing therebetween.

Another object of the invention is to provide such a device wherein the holding elements are U-shaped and are connected to a shifting bar of a sewing machine.

A further object of the invention is to provide a device for wrapping button shanks which is simple in design, rugged in construction and econcomical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the drawings in which.

DESCRIPTION OF THE PREFERRED EMBODIMENT

Figure 1:
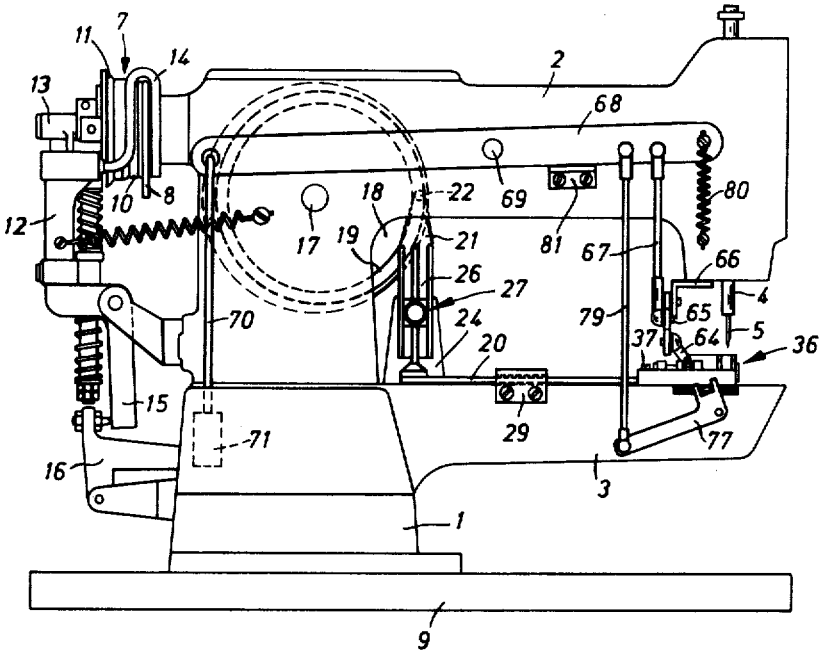
FIG. 1 is a rear elevational view of a sewing machine equipped with the invention.

Referring to the drawings in particular, the invention embodied therein, in FIG. 1 comprises a device for wrapping button shanks connecting a workpiece to a button, with thread in a sewing machine comprising, first and second holding elements which hold the workpiece apart from the button and between which the shank extends.

Figure 5:
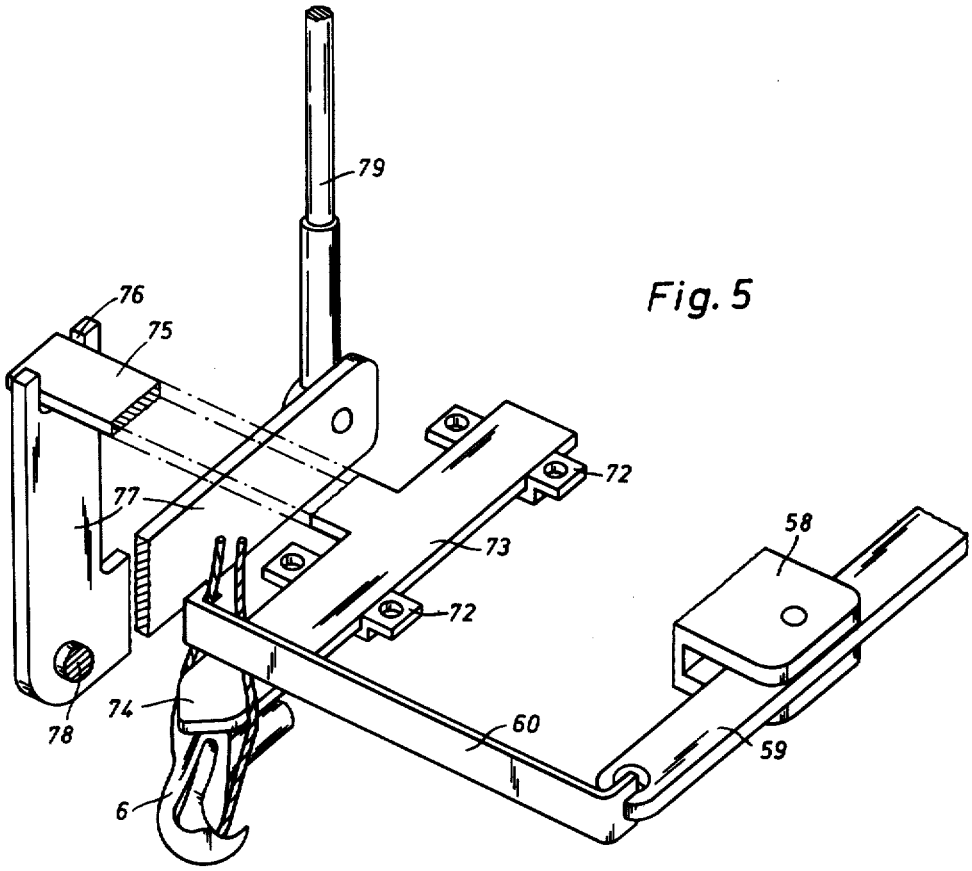
FIG. 5 is an enlarged perspective view of a part of the work holder.

The shown sewing machine comprises a post 1, an upper arm 2, and a lower arm 3. The main shaft (not shown) is mounted in upper arm 2, and drives, through known connecting members such as bevel gears, control shafts, etc., a needle bar 4 carrying the needle 5, and a rotary hook (FIG. 5) which is mounted in lower arm 3. Through a clutch 7, (FIG. 1) and a drive belt 8, the main shaft is connected to a drive motor which is mounted underneath a bed plate 9 of the machine.

In a known manner, clutch 7 comprises an idler pulley 10 freely mounted on the main shaft, and a drive pulley 11 fixed to the main shaft. Drive belt 8 can be shifted from idler pulley 10 to drive pulley 11 by means of a switch lever 12 which is pivotally mounted to post 1 and carries a brake 13 and a belt guard 14. Switch lever 12 is angled and its lower end 15 projects into the action range of a starting lever 16 which is hinged to post 1. By means of a well known connection, starting lever 16 is actuable by a foot operated treadle to couple the main shaft to the drive motor and, at the same time, disengage the mechanically effective brake 13.

Figure 2:
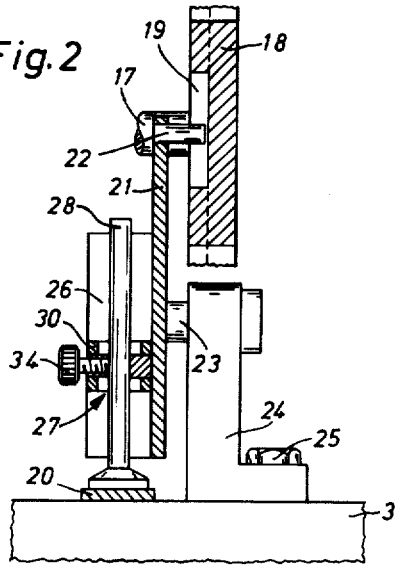
FIG. 2 is an enlarged sectional view of the transmission between the cam disc and the shifting bar for moving the work holder according to the invention.

Through a speed reduction apparatus, the main shaft drives a cam shaft 17 carrying a control disc 18 (FIG. 2), by which the displacement of a shifting or reciprocating bar 20 is controlled through a cam 19. Cam 19 effects this control by pivoting a double lever 21 which carries a pin 22 projecting into the path of motion of cam 19.

By means of a pivot pin 23 firmly fixed thereto, double lever 21 is journaled to a bearing bracket 24 which is secured to the lower arm 3 of the sewing machine by screws 25. Two fins carried by double lever 21 and extending parallel to each other form a slideway 26 for a crosshead or clamp 27 which is displaceably attached to a rod 28. Rod 28 is fixed to shifting bar 20 which slides in a guide 29 (FIG. 1) secured to lower arm 3.

Figure 3:
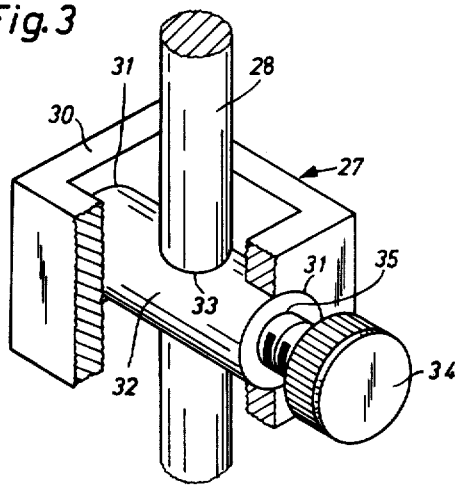
FIG. 3 is an enlarged perspective view, partly in section, of the crosshead forming part of the transmission.

Crosshead or clamp 27 comprises a box-like body 30 (FIG. 3) having walls which extend perpendicular to pivot pin 23 and are provided with bores 31 for receiving a hinge pin 32. Rod 28 extends through a bore 33 provided in hinge pin 32. The position of crosshead 27 on rod 28 can be fixed by means of a screw 34 engaging a tapped hole 35 of hinge pin 32.

Figure 4:
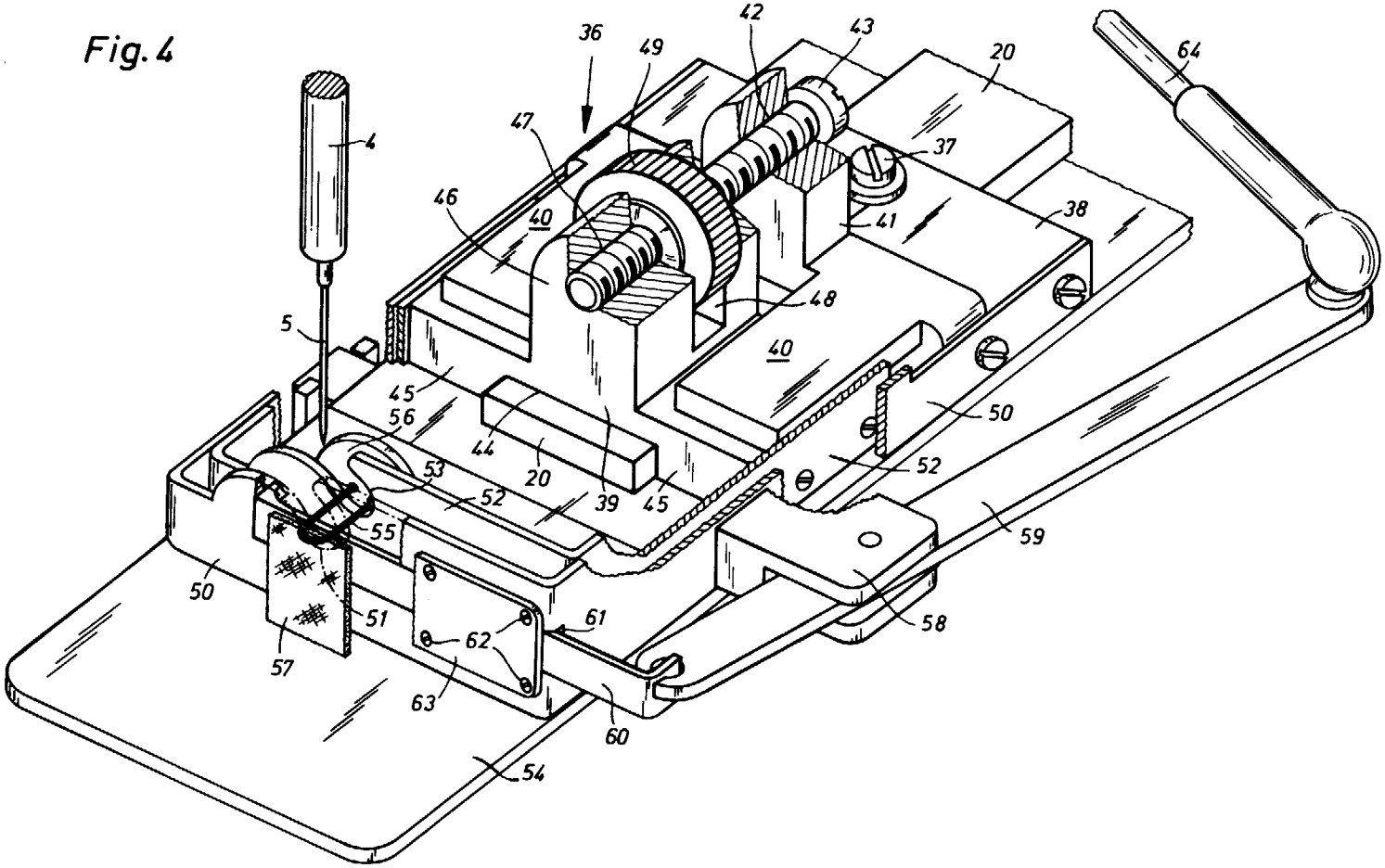
FIG. 4 is a perspective view, partly in section, of the work holder.

A work holder 36 (FIG. 4) is secured by a screw 37, to the end portion of shifting bar 20, close to the stitch forming area of the sewing machine.

Work holder 36 comprises a fixed guide piece 38 and a movable slide piece 39. Guide piece 38 carries two horizontally extending guide lugs 40 and an upwardly projecting bearing arm 41. Bearing arm 41 is provided with a tapped hole 42 which extends parallel to lower arm 3 and in which an adjustment screw 43 is received. Slide piece 39 is mounted for displacement between the two guide lugs 40 of guide piece 38, and shifting bar 20, with the shifting bar engaging a recess 44 of slide piece 39. Slide piece 39 comprises two side arms 45 guided by the two guide lugs 40 and a bearing arm 46 having a bore 47 which is coaxial with tapped hole 42 and is interrupted by a transverse slot 48 provided in bearing arm 46. Screw 43 which is received in bore 47 is screwed into a knurled nut 49 which is guided in slot 48.

The ends of the leg portions of a U-shaped strip 50, whose web portion has an obliquely upwardly open recess 51, are secured to guide piece 38. With U-strip 50, another U-strip 52 of smaller dimensions is provided, having its legs secured to slide piece 39. This U-strip is provided again with a recess 53 comformable to recess 51 and coaxial therewith in the longitudinal direction of lower arm 3. The web portions of U-strips 50, 52 extend over a needle plate 54 which is secured to the front end of lower arm 3 and provided with a needle hole (not shown) through which needle 5 cooperates with rotary hook 6. The purpose of recesses 51 and 53 of the two U-strips 50 and 52 is to receive shank loops 55 by which a button 56 is connected to a work 57.

One leg of U-strip 50 carries a bearing bracket 58 for a lever 59. One end of lever 59 is forked to engage the angled end of a cutting blade 60 which is guided in a slot 61 of the web portion of U-strip 50. The guidance of blade 60 in slot 61 is made possible by two guard plates 63 covering the slot on the inside and outside and secured to the web portion by screws 62. Lever 59 is acted upon by a link 64 which is connected to one arm of an angle lever 65 (FIG. 1).

Angle lever 65 is supported on a bracket 66 secured to upper arm 2 and connected, through its second arm, to a tie rod 67 which is hinged to a double lever 68. Double lever 68 is supported on upper arm 2 by means of a pivot pin 69 and connected through a tie rod 70 to a solenoid 71 which is accommodated in post 1 of the sewing machine, to be briefly energized after each sewing operation by a pulse from the sewing machine control.

Beneath the plate 54, two guide brackets 72 (FIG. 5) are provided in which a thread spreader 73 is guided in the longitudinal direction of lower arm 3. Spreader 73 has a wedge-shaped tip 74 and a laterally projecting arm 75 which is engaged at its free end in a recess 76 provided in the end portion of a bell crank 77. Crank 77 is pivoted at 78 to lower arm 3 and connected, through a tie rod 79 (FIG. 1), to double lever 68. In a normal position, double lever 68 is pulled by a spring 80 into contact with a stop 81 provided on upper arm 2.

The device operates as follows:

The work 57, with the button 56 attached by means of shank loops 55, is placed in the work holder in a position such that shank loops 55 engage into both recesses 51 and 53 and work 57 is held apart from button 56 by the two U-strips 50 and 52. The spacing between U-strips 50, 52 is adjusted to the extended or reduced length of shank loops 55, and this is done by turning knurled nut 49, thus displacing it on screw 43, whereby, through bearing arm 46, slide piece 39 which is received between guide lugs 40 and shifting bar 20 is taken along.

As the drive motor is switched on, drive belt 8 runs on idler pulley 10. Upon actuating the treadle and thereby starting lever 16 through a control connection (not shown), the machine is started. Starting lever 16 imparts a pivotal motion to shifting lever 12 so that belt 8 is shifted by guide 14 from idler pulley 10 to drive pulley 11 and mechanical brake 13 is disengaged from drive pulley 11.

At the same time, through cam 19 and pin 22, control disc 18 causes pivoting of double lever 21 whereby crosshead 27 received within slideway 26 is pivoted too. Rod 28 is taken along by hinge pin 32 following the motion of body 30, and displaces shifting bar 20 in the axial direction of lower arm 3 of the machine. Work holder 36 which is connected to shifting bar 20 is thereby taken along to the same extent.

As the sewing machine is started, needle 5, in a manner known per se, makes zig zag switches around shank loops 55. Work holder 36 is reciprocated by control disc 18 in such a way at the start of the sewing operation, the needle works in close proximity to work 57, then the stitches advance in the direction of button 56, whereupon the motion of the work holder 36 is reversed and the last stitches are made again in close proximity of work 57.

After the last stitch is made, a cam provided on control disc 18 actuates switch lever 12 in a known manner to shift belt 8 from drive pulley 11 back to idler pulley 10, by means of guide 14. The machine is then stopped by brake 13 which engages drive pulley 11.

Following the end of the sewing operation, the control of the sewing machine briefly energizes solenoid 71 so that, through tie rod 70, double lever 68 is pivoted through a definite angle against the action of spring 80. By means of tie rod 79, double lever 68 actuates bell crank 77 by which tip 74 of thread spreader 73 is introduced into the thread loop formed about rotary hook 6, to spread the thread portions apart.

The pivoting of double lever 68 is simultaneously transmitted through tie rod 67 and link 64 to lever 59 which is pivoted about its fulcrum 58. The cutting edge of blade 60 is thereby moved from its end position against the thread loop portion shown in FIG. 5 at the left hand side, so that this thread portion, leading to the work, is cut through.

Now, the work 57 with a shank of thread wrapped around shank loops 55 of button 56 can manually be removed from work holder 36. To wrap longer or shorter shank loops 55, the spacing of U-strips 50,52 from each other is set by turning knurled nut 49. Thus by displacing slide piece 39 relative to guide piece 38, to adjust the position of U-strip 52, crosshead 27 may then be adjusted in its vertical position to the changed displacement of work holder 36 caused by the newly set spacing between U-strips 50 and 52. By loosening screw 34, the length of the lever arm between pivot pin 23 and crosshead 27 can be varied to set the traveling range, controlled by cam 19, of bar 20 and work holder 36.

While a specific embodiment of the invention has been shown and described in detail to illustrate the application of the principles of the invention, it will be understood that the invention may be embodied otherwise without departing from such principles.

What is claimed is:

1. A device for wrapping button shanks connecting a workpiece to a button, with thread in a sewing machine comprising, a first holding element against which the workpiece can bear, a second holding element against which the button can bear spaced from the first holding element with the shank extending between the first and second holding elements, and adjustment means connected to the first and second holding elements for adjusting the spacing therebetween.

2. A device according to claim 1, wherein the sewing machine includes reciprocating needle means for wrapping the button shanks with thread and a shifting bar associated with the reciprocating needle means for shifting the position of the shanks, said first and second holding elements comprising first and second U-shaped strips, one of said first and second U-shaped strips fixedly connected to said shifting bar, the other of said first and second U-shaped strips slidably mounted with respect to said shifting bar.

3. A device according to claim 2, including a fixed guide piece connected between said shifting bar and said one of said first and second U-shaped strips, a sliding guide piece slidably mounted to said fixed guide piece and said shifting bar connected to the other of said first and second holding elements, said adjustment means comprising a threaded shaft connected between said fixed and sliding guide pieces, a threaded nut threaded to said threaded shaft and rotatably mounted to one of said fixed and sliding guide pieces at a fixed position with respect to the sliding direction of said sliding guide piece.

4. A device according to claim 2, wherein one of said first and second U-shaped strips is positioned within the other of said first and second U-shaped strips, said first and second U-shaped strips including aligned recesses for receiving the button shanks.

5. A device according to claim 2, wherein the sewing machine includes rotary hook means associated with said reciprocating needle means for wrapping the button shanks with thread, a cutting blade slidably guided between said first and second holding elements for cutting thread extending between said first and second holding elements and between a shank and said rotary hook means at the end of a sewing operation, and a drive linkage connected to said cutting blade for moving said cutting blade at the end of the sewing operation.

6. A device according to claim 5, wherein said cutting blade is slidably mounted in an opening provided in one of said first and second U-shaped strips to move transversely to a direction of movement of said reciprocating needle means.

7. A device according to claim 5, including a thread spreading member including a wedge shaped strip and drive means connected to said thread spreading member to move said wedge shaped strip into the loop of a thread held by said rotary hook means.

8. A device according to claim 5, wherein said drive linkage for moving said cutting blade comprises a lever pivotally mounted to one of said first and second U-shaped strips having one end engaged with said cutting blade and an opposite end connected to drive means of the sewing machine.

* * * * *